US010311850B2

(12) United States Patent
Canivell Grifols

(10) Patent No.: US 10,311,850 B2
(45) Date of Patent: Jun. 4, 2019

(54) EXCHANGEABLE PICKUP SUPPORT FOR STRING MUSICAL INSTRUMENT

(71) Applicant: LLEVINAC, S.L., Barcelona (ES)

(72) Inventor: Jordi Canivell Grifols, Barcelona (ES)

(73) Assignee: LLEVINAC, S.L., Barcelona (ES)

( * ) Notice: Subject to any disclaimer, the term of this patent is extended or adjusted under 35 U.S.C. 154(b) by 0 days.

(21) Appl. No.: 15/867,032

(22) Filed: Jan. 10, 2018

(65) Prior Publication Data

US 2018/0204558 A1 Jul. 19, 2018

(30) Foreign Application Priority Data

Jan. 19, 2017 (ES) ..... 201730062

(51) Int. Cl.

| | |
|---|---|
| ***G10H 3/00*** | (2006.01) |
| ***G10H 3/18*** | (2006.01) |
| ***G10D 1/08*** | (2006.01) |
| ***H04R 1/02*** | (2006.01) |

(52) U.S. Cl.

CPC ..... *G10H 3/181* (2013.01); *G10D 1/085* (2013.01); *G10H 3/183* (2013.01); *H04R 1/025* (2013.01); *G10H 2220/461* (2013.01)

(58) Field of Classification Search

CPC .... G10H 3/181; G10H 1/32; G10H 2220/525; G10H 2220/461; G10D 1/085; G10K 2210/3229

See application file for complete search history.

(56) References Cited

U.S. PATENT DOCUMENTS

| | | | | |
|---|---|---|---|---|
| 4,854,210 A * | 8/1989 | Palazzolo | ..... | G10H 3/181 84/726 |
| 5,029,511 A * | 7/1991 | Rosendahl | ..... | G10H 3/181 84/723 |
| 5,072,646 A | 12/1991 | Valkama | | |
| 5,252,777 A * | 10/1993 | Allen | ..... | G10H 3/182 84/726 |
| 5,894,101 A * | 4/1999 | Damm | ..... | G10H 3/181 84/723 |

(Continued)

FOREIGN PATENT DOCUMENTS

DE 102010017697 A1 1/2012

OTHER PUBLICATIONS

Spanish Search Report dated Apr. 25, 2017 for Application No. 201730062 in 4 pages.

(Continued)

*Primary Examiner* — Marlon T Fletcher
(74) *Attorney, Agent, or Firm* — Knobbe, Martens, Olson & Bear, LLP

(57) ABSTRACT

An interchangeable pickup support is for a stringed musical instrument. The support is of the type that includes at least a base body provided with an attachment to a stringed musical instrument and a support for supporting and attaching the pickup to the base body. The attachment includes at least a fastener which is movable by an actuator which is rigidly connected to the fastener, the ends of which are configured to project in part through respective holes arranged on the outer surface of the base body and attached to the stringed musical instrument. The base body also includes at least a retainer for the fastener in the attachment to the stringed musical instrument.

9 Claims, 18 Drawing Sheets

(56) References Cited

U.S. PATENT DOCUMENTS

| | | | | |
|---|---|---|---|---|
| 6,111,184 | A | 8/2000 | Cloud et al. | |
| 6,253,654 | B1 * | 7/2001 | Mercurio | G10D 1/085 84/267 |
| 7,538,269 | B2 | 5/2009 | Ekstrom | |
| 7,838,758 | B2 | 11/2010 | Van Ekstrom | |
| 2015/0027300 | A1 * | 1/2015 | Wolf | G10H 3/181 84/726 |
| 2015/0356955 | A1 * | 12/2015 | Brown, Jr. | G10D 1/085 84/267 |
| 2016/0019870 | A1 * | 1/2016 | Park | G10D 1/085 84/292 |
| 2017/0053631 | A1 | 2/2017 | Strassell | |

OTHER PUBLICATIONS

Extended European Search Report for Application No. 18382004.2 dated May 4, 2018 in 9 pages.

* cited by examiner

EXCHANGEABLE PICKUP SUPPORT FOR STRING MUSICAL INSTRUMENT

FIELD OF THE INVENTION

The present invention relates to the music sector and, in particular, it relates to an interchangeable pickup support for stringed musical instruments, in particular electric stringed musical instruments, such as electric guitars, electric basses or electric violins, for example.

BACKGROUND OF THE INVENTION

Pickups for electric stringed musical instruments are transducers which convert the vibration of the strings of the musical instrument into an electric signal. Different types of pickup exist depending on the physical principle by which the vibration of the strings is captured, the most usual being electromagnetic pickups. This type of pickup comprises a coil which creates a magnetic field, so that the vibration of the ferromagnetic strings induces a current in the coil that is proportional to the amplitude of the movement and of a frequency equal to that of the oscillation of the strings. Said pickups, also known as microphones or capsules are usually arranged in a housing of the body of the musical instrument just beneath the strings. The pickups are usually arranged in said housing of the body of the musical instrument by means of a pickup support which normally comprises means of attachment to the housing of the stringed musical instrument. Said attachment means to the musical instrument are usually of the removable connection type to allow the pickup of the musical instrument to be exchanged for another.

By way of example, Spanish Patent Application no. 201630058 discloses an example of a pickup support in which the means of attachment to the musical instrument consist of threaded elements. However, although the use of threaded elements is very reliable as mechanical attachment means, some time is required when exchanging one pickup support for another, owing mainly to the steps of unscrewing and screwing the threaded elements. Consequently, this type of removable connection attachment means is not convenient when interchanging pickup supports, for example during a musical performance.

U.S. Pat. No. 6,111,184 discloses another example of a pickup support in which the attachment means to the musical instrument consist of spring and ball positioners arranged in internal channels both in the pickup support and in the musical instrument. Thus, when the pickup support is arranged in the housing of the musical instrument, the respective ball positioners are seated in the respective ball positioners arranged in the housing of the guitar instrument, so as to hold the pickup support in the housing of the musical instrument, as shown in FIG. 3 of U.S. Pat. No. 6,111,184. In this case, the arrangement of the pickup support in the corresponding housing of the musical instrument is carried out more quickly and efficiently than when using threaded elements (Spanish Patent Application no. 201630058). However, attachment by means of said ball positioners is less stable, in particular against the vibrations produced by the strings of the musical instrument. In addition, both the positioning and the removal of the pickup support must be produced by pressure, which on occasions makes quick and efficient positioning and/or removal of the pickup support by the musician difficult during a performance, mainly owing to a lack of strength.

SUMMARY OF THE INVENTION

The present invention discloses an improved pickup support having more efficient means of attachment to the musical instrument and which aims to overcome the above-mentioned problems of known pickup supports. In particular, the present invention discloses a pickup support having means of attachment to the musical instrument which allow fast and efficient positioning and removal of the pickup support while maintaining a stable attachment between the pickup support and the musical instrument.

In particular, the present invention discloses an interchangeable pickup support for a stringed musical instrument according to the main claim 1. Said interchangeable pickup support is of the type which comprises at least a base body provided with means of attachment to a stringed musical instrument and means for supporting and attaching the pickup to said base body, characterized in that said means for attaching the base body to a stringed musical instrument comprise at least a fastener element which is movable by actuation means which are rigidly connected to the fastener element, the ends of which are configured to project in part through respective holes arranged on the outer surface of said base body and to be attached to respective receiving grooves arranged in the stringed musical instrument during movement of said fastener element by said actuation means, said base body also comprising at least an element for retaining the fastener element in the attachment thereof to the stringed musical instrument.

The support according to the present invention allows faster and more efficient positioning and removal thereof than in the prior art, while at the same time maintaining a stable attachment of said support to the musical instrument.

According to a first embodiment of the present invention, the fastener element preferably comprises two symmetrical ends configured to project in part through two respective holes arranged on the outer surface of said base body.

According to a second embodiment of the present invention, the fastener element preferably comprises four symmetrical ends configured to project in part through four respective holes arranged on the outer surface of said base body.

Preferably, the fastener element can be moved in a radial direction relative to the midpoint thereof.

Preferably, the means for actuating the fastener element consist of respective through-holes arranged on either side of the midpoint of the surface of the fastener element, allowing the fastener element to be manoeuvred by the action of two fingers of the user.

Preferably, the retaining element consists of two helical springs which are arranged vertically on the fastener element and apply pressure to said fastener element against the base body.

Preferably, the fastener element is a planar element the ends of which have a partially sloping termination. Said configuration helps reduce friction during movement of the fastener element when being attached to the stringed musical instrument.

In addition, said support preferably comprises means for adjusting the position and slope of the pickup relative to the support.

Another object of the present invention is to disclose a stringed musical instrument which comprises an interchangeable pickup support according to the present invention.

Preferably, the stringed musical instrument is an electric guitar.

BRIEF DESCRIPTION OF THE DRAWINGS

To aid understanding of the invention, the accompanying drawings are given as an explanatory but non-limiting example of two embodiments of the pickup support for stringed musical instruments.

DETAILED DESCRIPTION OF THE PREFERRED EMBODIMENTS

FIGS. 1 to 4 are respective perspective, from above and below views of a first embodiment of a pickup -300- support -1-. Said support -1- comprises a base body -100- which is the portion of the support -1- which is attached to the stringed musical instrument. In addition, said support -1- comprises a plate (not shown) to which the pickup -300- is attached by means, for example, of screws normally arranged at the ends thereof. In addition, the pickups comprise a decorative casing -200- which covers the entirety of said plate (not shown) to which the pickup -300- is attached by the corresponding screws for adjustment and attachment of the pickup -200- to the plate. As can be seen in 1 and 2, according to this first embodiment of the pickup -300- support -1-, the base body -100- has a rectangular prismatic shape closed by a lower plate -140- (see FIG. 4), comprising, on each of the faces thereof that are opposite one another along the longitudinal axis of said base body -100-, two holes -110-, -120- through which may project, as will be seen below, respective ends -111- and -121- of a fastener element -130- illustrated in FIG. 5.

Figure 1:
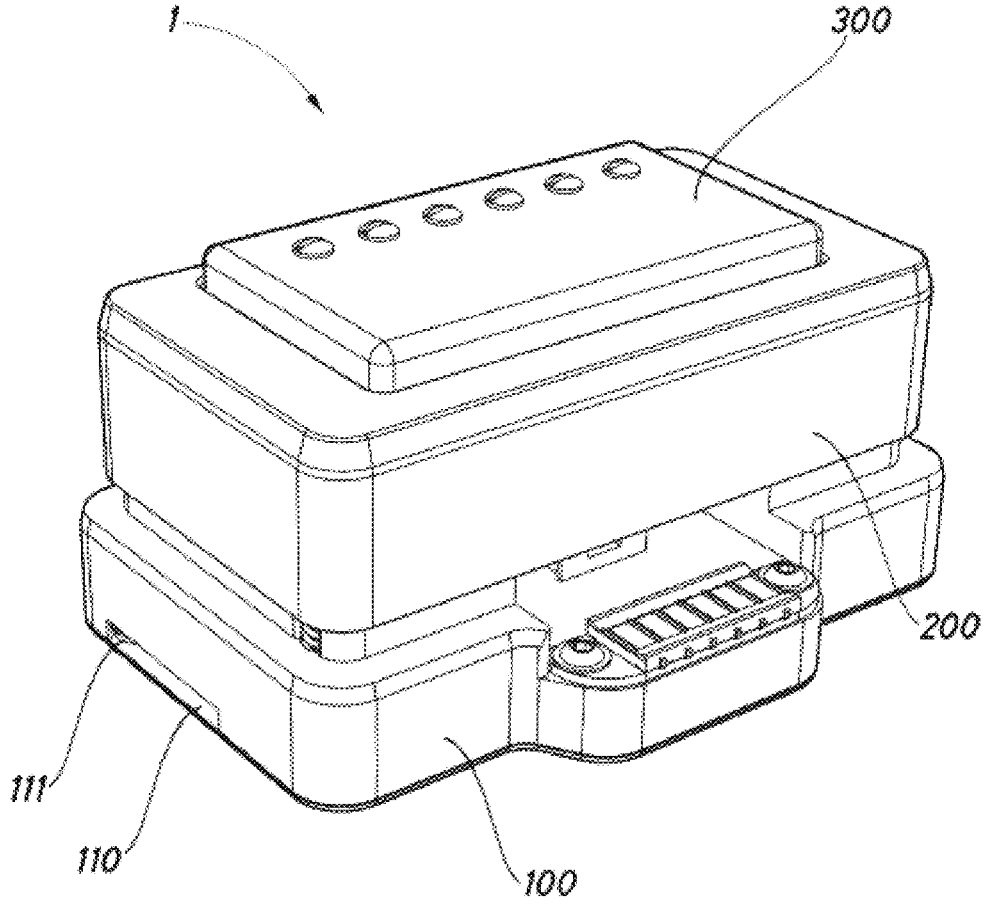
FIG. 1 is a first perspective view of a pickup support according to a first embodiment of the present invention.
Figure 2:
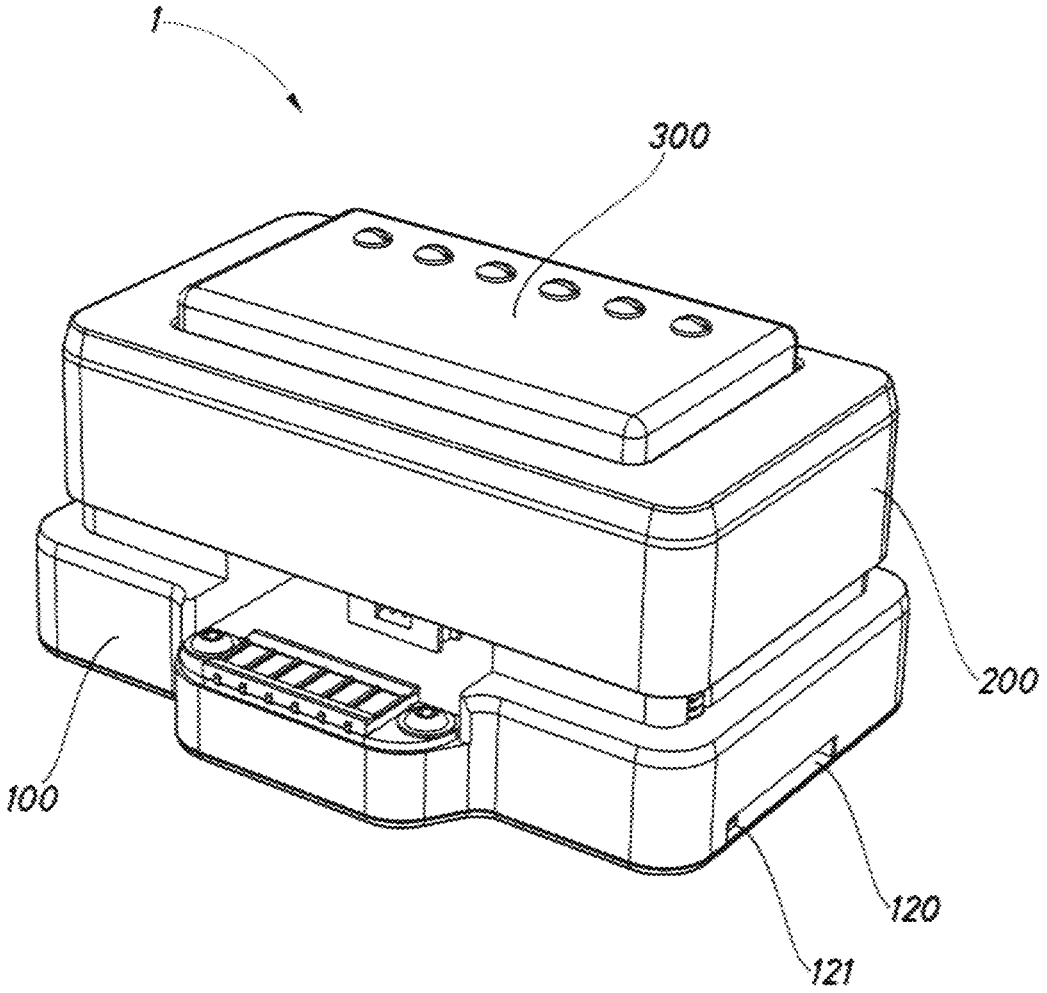
FIG. 2 is a second perspective view of the pickup support according to a first embodiment of the present invention.
Figure 3:
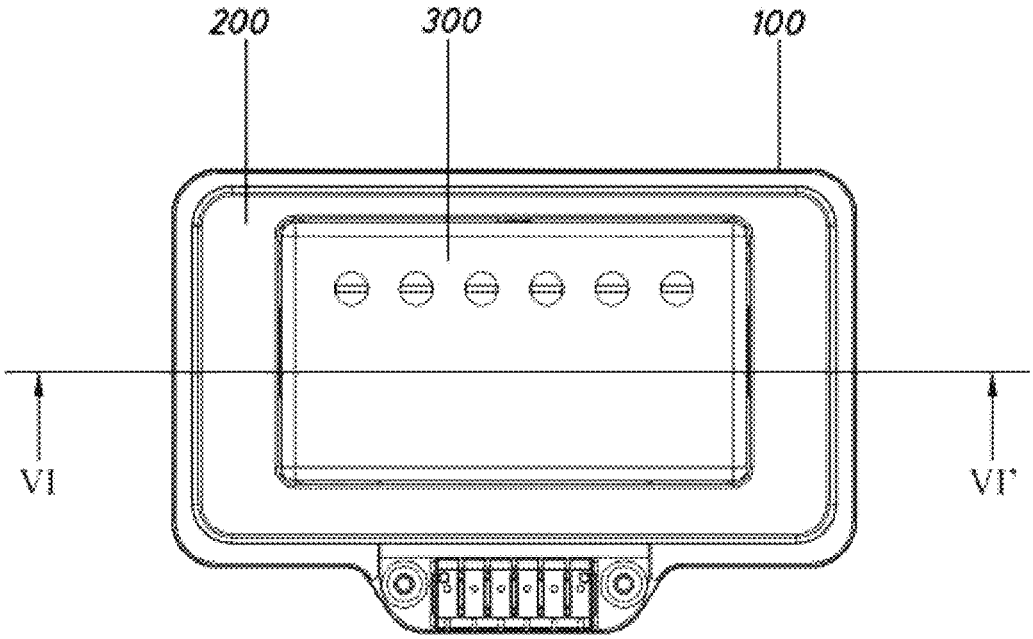
FIG. 3 is a view from above of the pickup support according to a first embodiment of the present invention.
Figure 4:
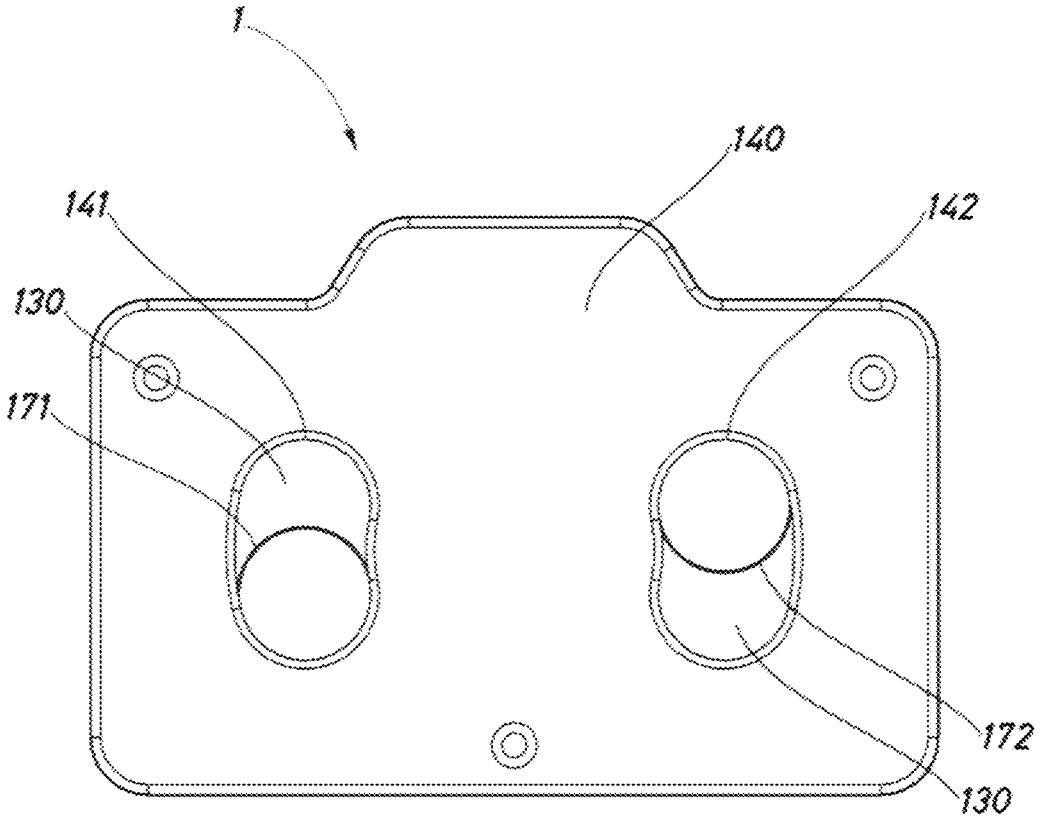
FIG. 4 is a view from below of the pickup support according to a first embodiment of the present invention.

In addition, as shown in FIG. 4, the fastener element -130- comprises through-holes -171- and -172- arranged on either side of the midpoint of the surface of the fastener element -130- (also shown in greater detail in FIG. 5) which allow two respective fingers of the user to be inserted in order to manoeuvre and move the fastener element -130- between two positions, as will be explained later. In addition, the lower plate -140- of the base body -100- comprises respective through-holes -141- and -142- through which a user can gain access using the respective fingers in order to manoeuvre the fastener element -130- through the respective holes thereof -141- and -142-. Said through-holes -141- and -142- are of the elongate type so as to allow movement of the fastener element -130- through the respective holes thereof -141- and -142- between a connection position (in which the ends -111- and -121- of the fastener element -130- project through the respective holes -110-, -120- of the base body -100-, as can be seen for example in FIGS. 7, 12 and 13) and a disconnection position (in which the ends -111- and -121- of the fastener element -130- move backwards until said ends are once more inside the base body -100-, as shown for example in FIGS. 6, 10 and 11).

Figure 5:
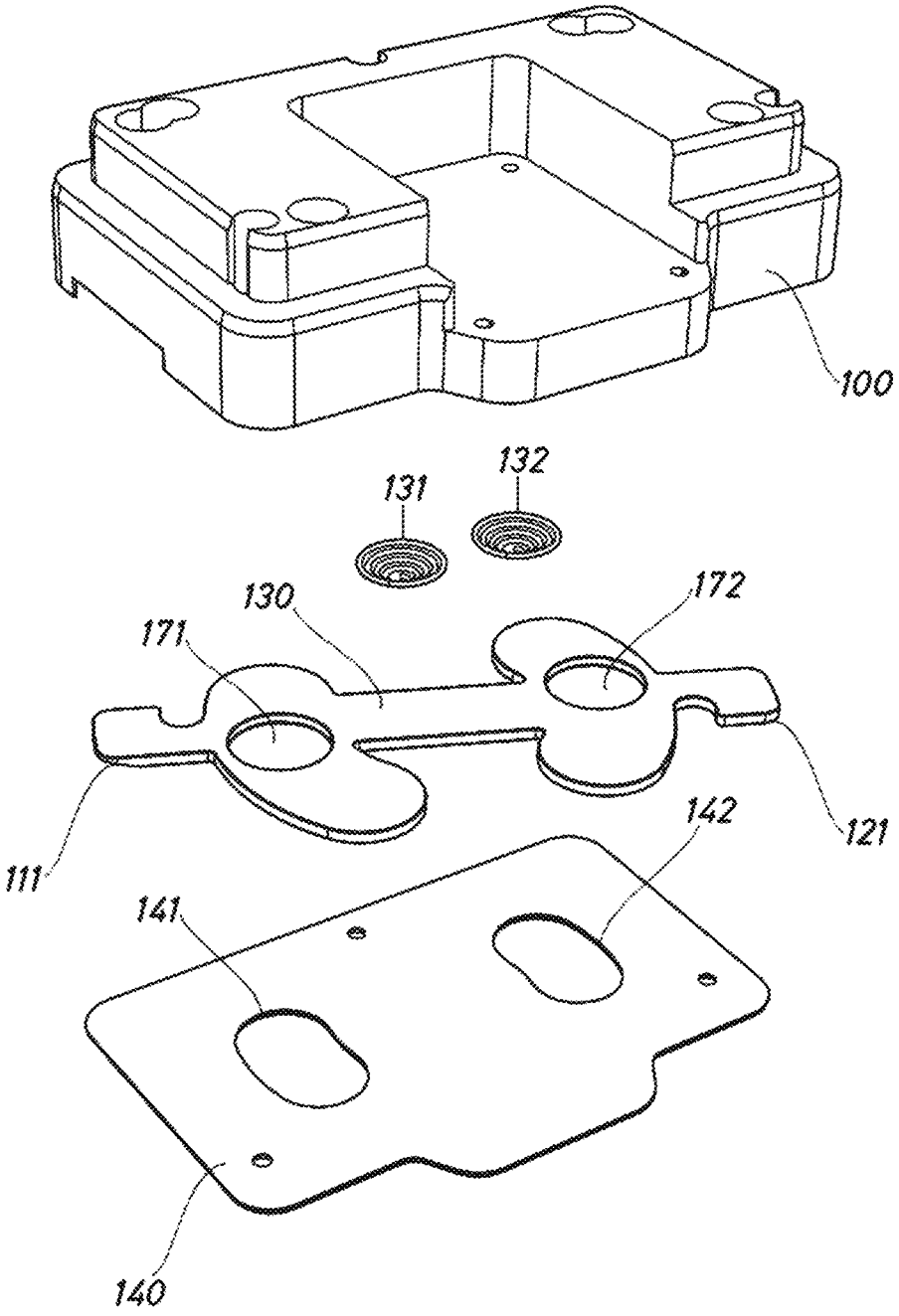
FIG. 5 is an exploded perspective view of some elements of the pickup support according to a first embodiment of the present invention.
Figure 6:
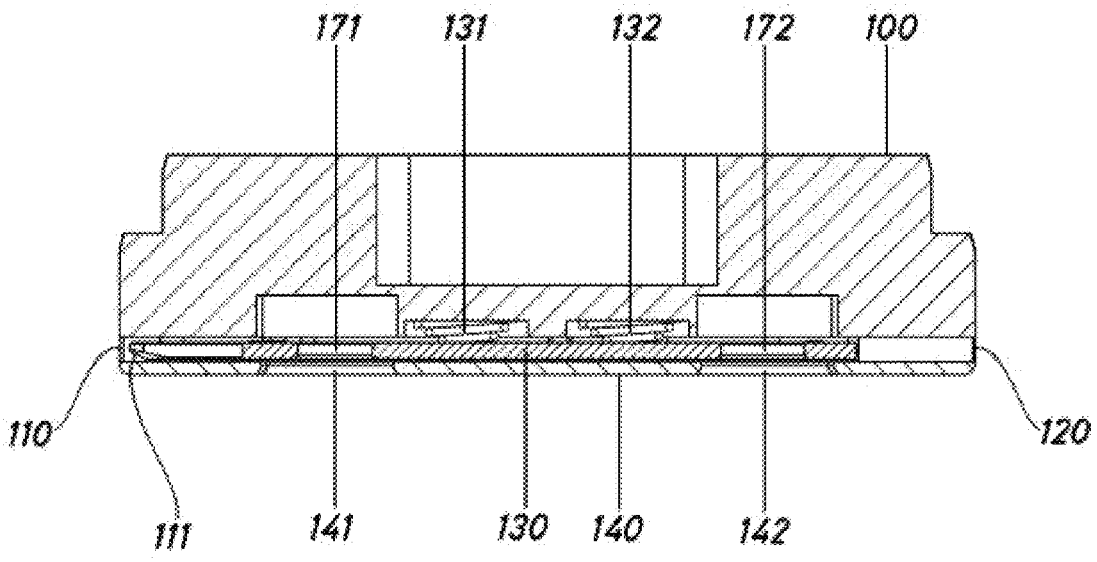
FIG. 6 is a cross section of the pickup support through the plane VI-VI' of FIG. 3.

In addition, as can be seen in FIGS. 5 and 6, the base body -100- comprises a housing in the interior thereof where the fastener element -130- is located, said housing being suitable to allow the guidance and movement of said fastener element -130- between said connection and disconnection positions. As can be seen in said FIG. 5, the fastener element -130- is preferably planar with a shape adapted to the space inside the base body -100- so as to be able to produce the trajectory of movement thereof unimpeded by internal elements of said pickup -300- support -1-, such as attachment screws or additional springs, among others. Moreover, as can be seen in FIG. 6, the ends -111- and -121- have a partially sloping termination which, as will be seen later, facilitates the movement of the fastener element -130- when being connected to the stringed musical instrument. In addition, the base body -100- also comprises means for retaining the fastener element -130-, which consist of two helical, preferably conical, springs -131- and -132- arranged vertically on the fastener element -130-, preferably on either side of the midpoint of said fastener element -130-. Said helical springs -131- and -132- are configured to apply constant pressure to said fastener element -130- against the lower plate -140- of the base body -100-, both in said connection position and in the disconnection position.

Figure 7:
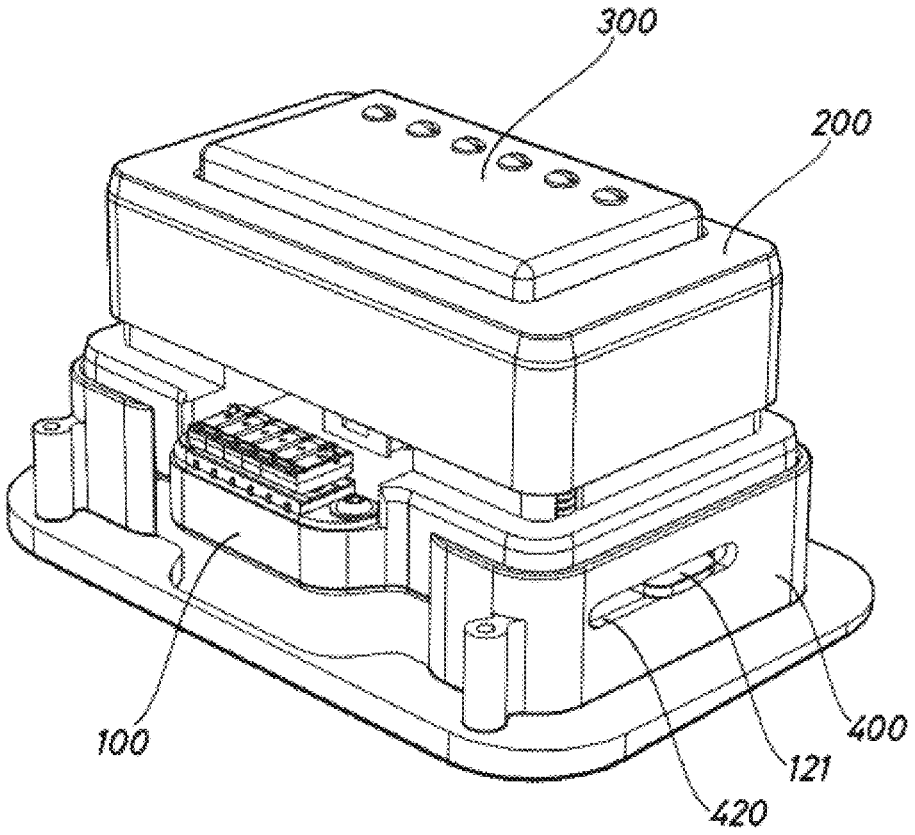
FIG. 7 is a perspective view of the pickup support according to a first embodiment of the present invention attached to an external element of the stringed musical instrument by the ends of the fastener element.
Figure 8:
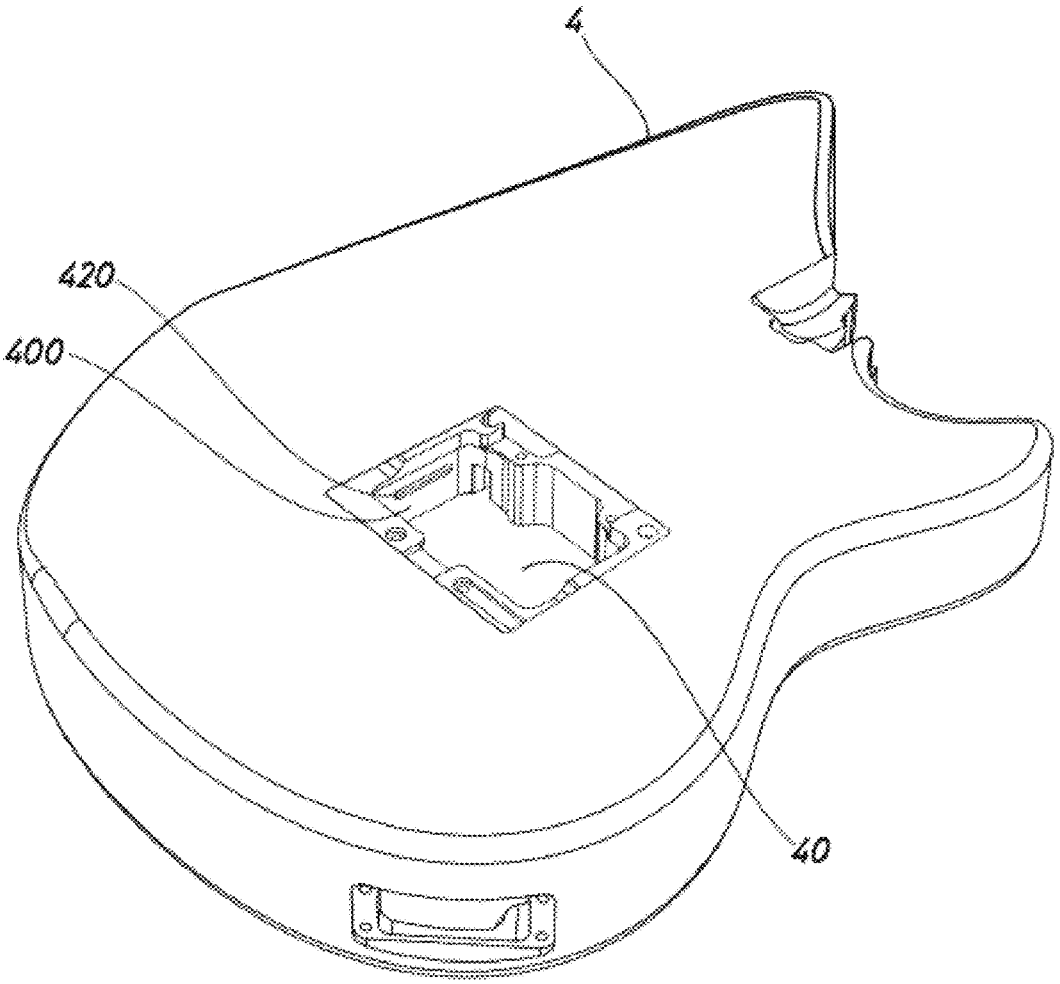
FIG. 8 is a perspective view of a stringed musical instrument with the location of the external element shown in FIG. 7 where the pickup support according to the present invention will be attached.
Figure 9:
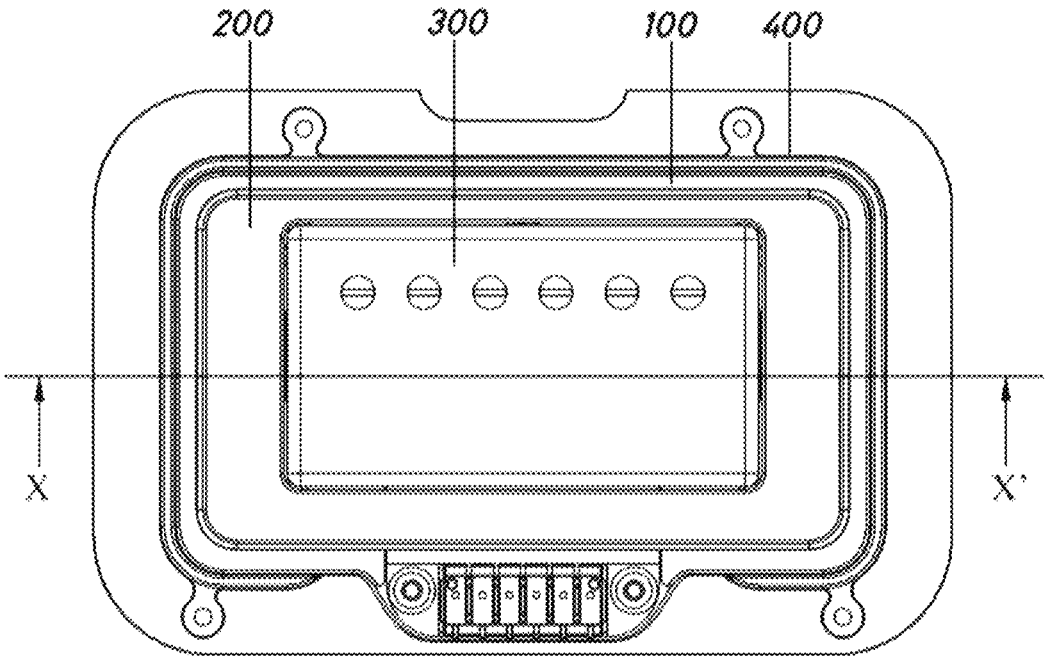
FIG. 9 is a view from above of the pickup support according to FIG. 7.

The pickup -300- support -1- may either be connected directly to the body of a guitar (not shown), which has grooves or holes for receiving the respective ends -111-, -112-, or may be connected to an external element -400-, as can be seen in FIGS. 7 and 9, said external element -400- in turn being connected to a hole -40- made in a body -4- of a stringed musical instrument, such as a guitar, for example (see FIG. 8).

Figure 10:
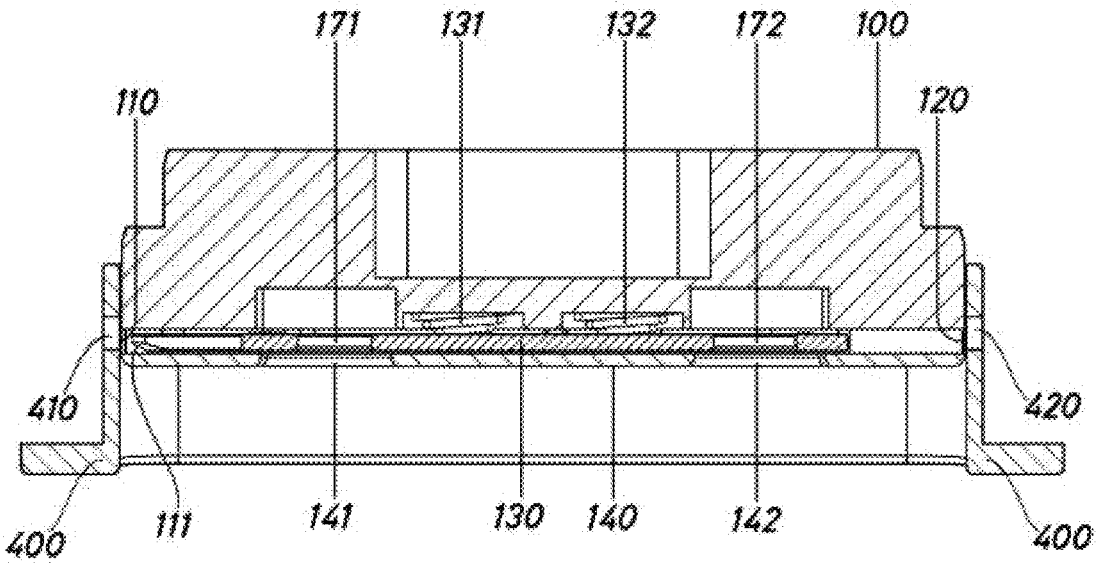
FIG. 10 is a cross section of the pickup support through the plane X-X' of FIG. 9 in which the pickup support is not attached to the external element of the stringed musical instrument.
Figure 11:
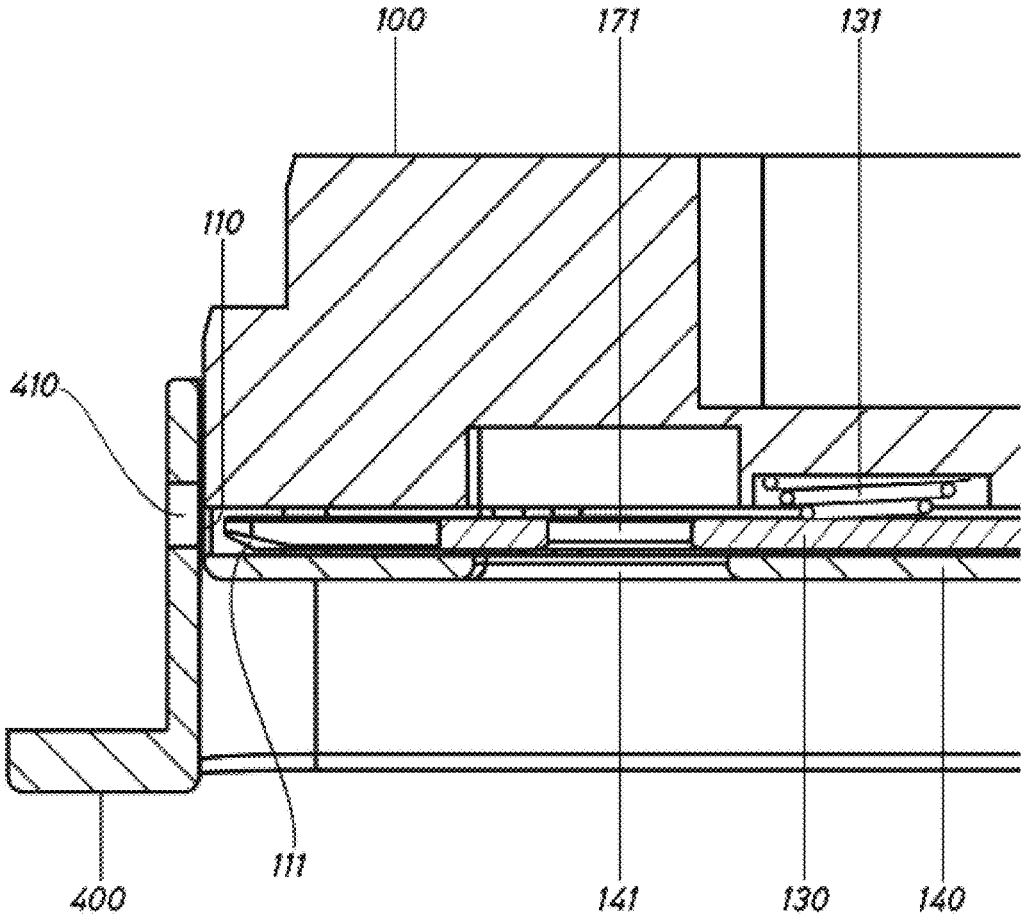
FIG. 11 is an enlarged section of the cross section of FIG. 10.
Figure 12:
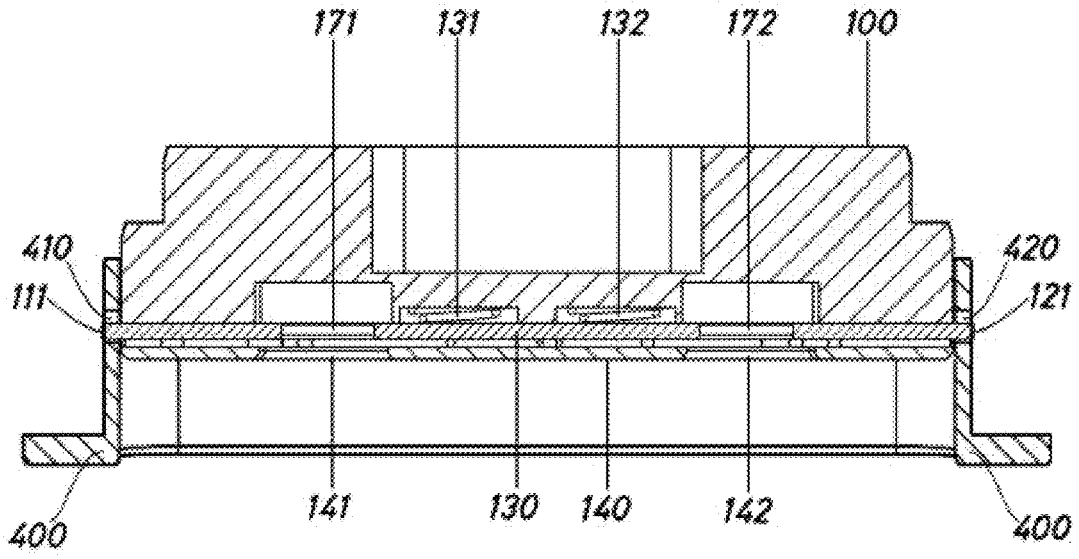
FIG. 12 is a cross section of the pickup support through the plane X-X' of FIG. 9 in which the support is attached to the external element of the stringed musical instrument by the ends of the fastener element.
Figure 13:
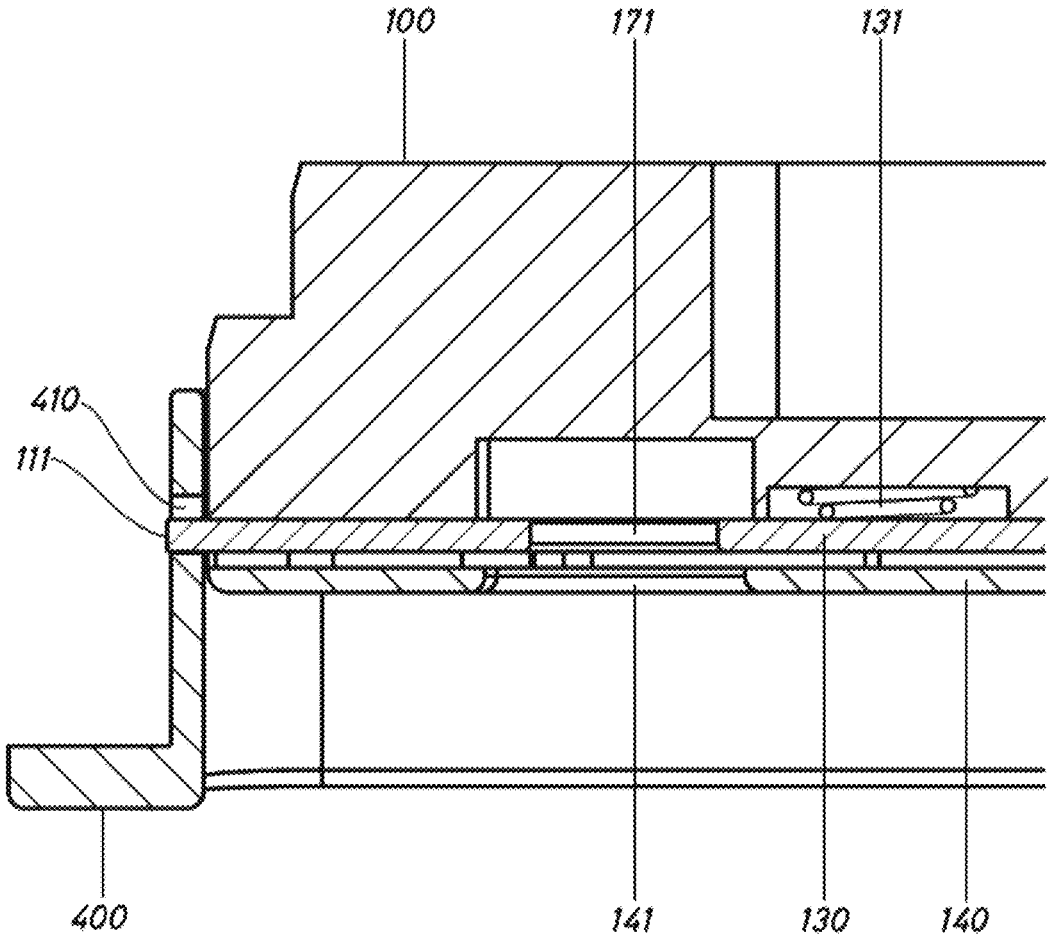
FIG. 13 is an enlarged section of the cross section of FIG. 12.
Figure 14:
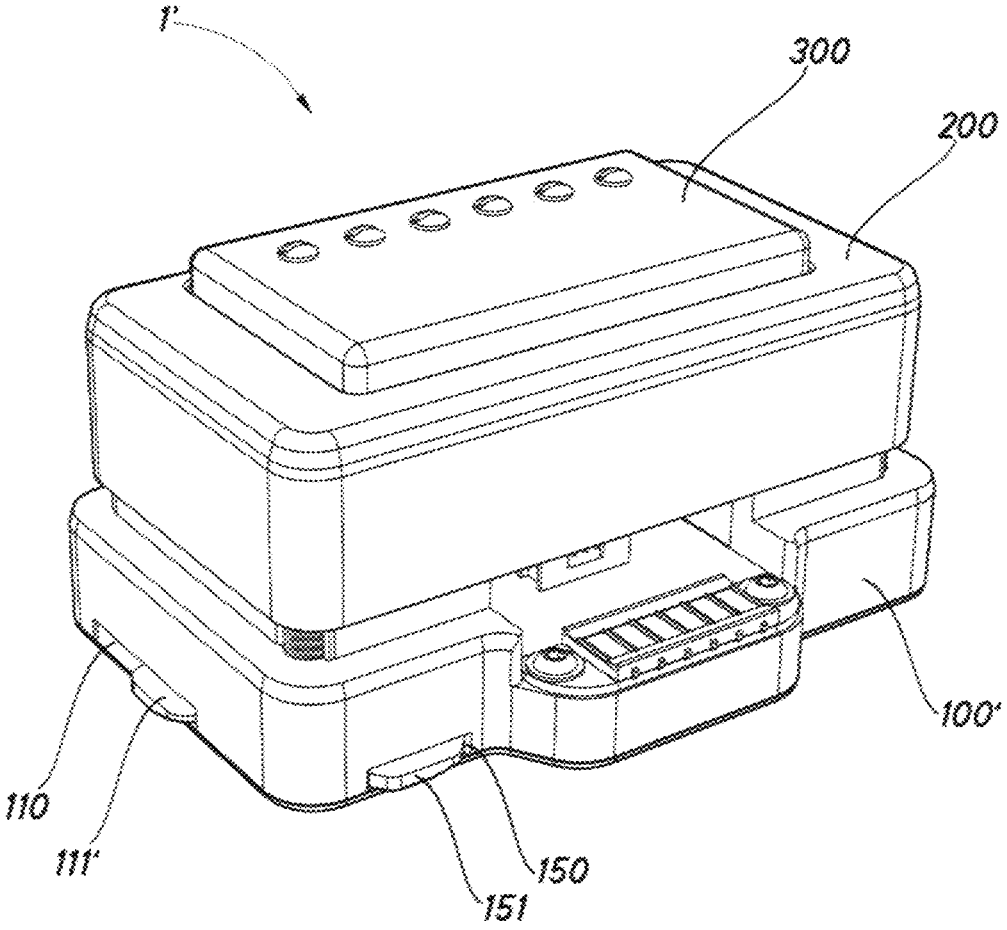
FIG. 14 is a first perspective view of a pickup support according to a second embodiment of the present invention.
Figure 15:
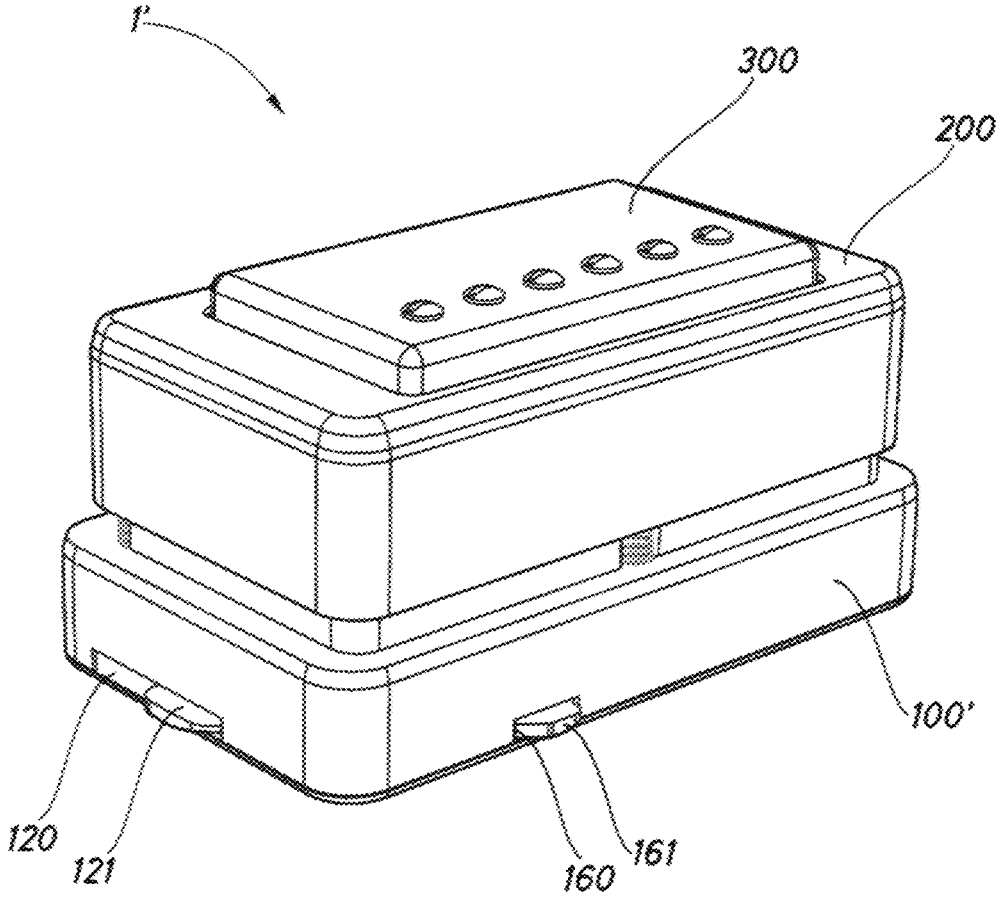
FIG. 15 is a second perspective view of the pickup support according to a second embodiment of the present invention.
Figure 16:
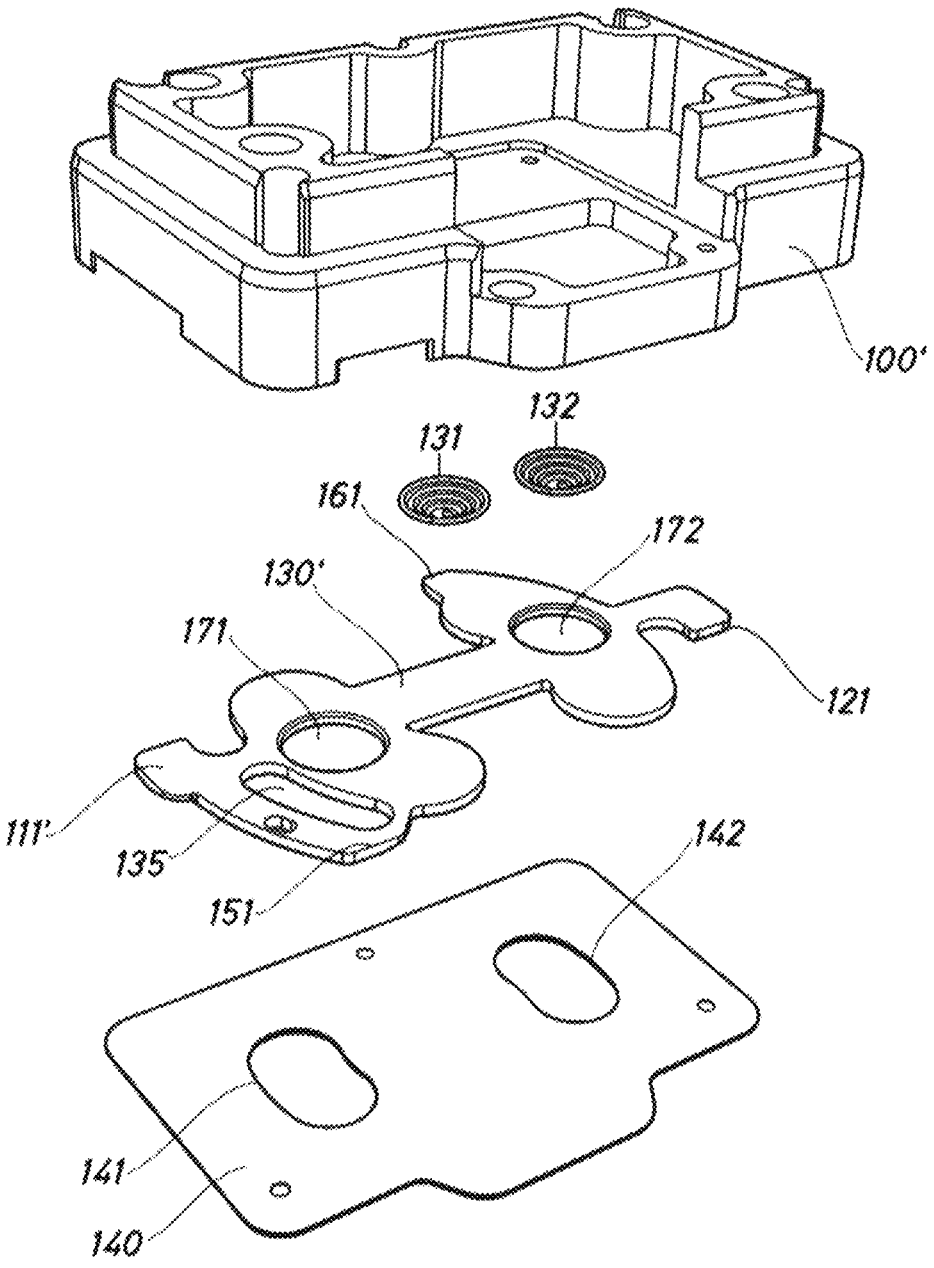
FIG. 16 is an exploded perspective view of some elements of the pickup support according to a second embodiment of the present invention.
Figure 17:
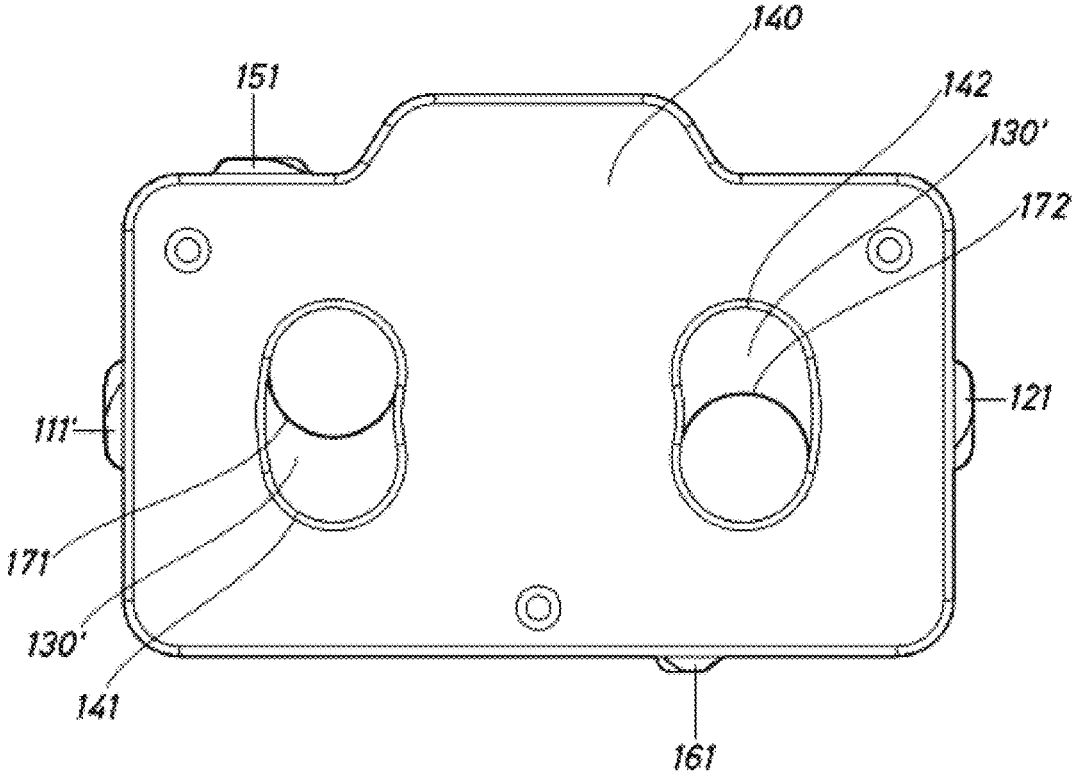
FIG. 17 is a view from below of the pickup support according to a second embodiment of the present invention in the attachment position.
Figure 18:
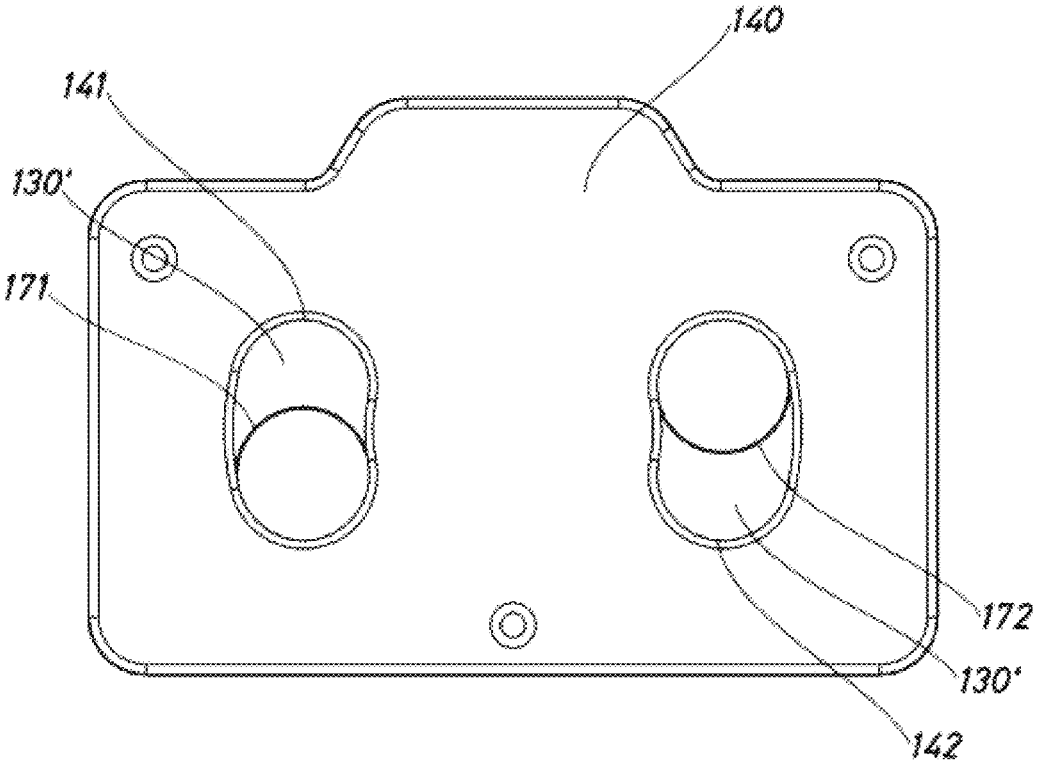
FIG. 18 is a view from below of the pickup support according to a second embodiment of the present invention in the release position.

FIGS. 10 and 11 show the pickup -300- support in the disconnection position of the fastener element -130- with respect to the external element -400-, whereas FIGS. 12 and 13 show the pickup -300- support in the connection position of the fastener element -130- with respect to the external element -400-. Between the disconnection position and the connection position, the user previously inserts two fingers of his or her hand through the holes -171- and -172- of the fastener element -130- through the respective elongate holes -141- and -142- of the lower plate -140- of the base body -100- and moves said fastener element -130- along the trajectory defined internally in the base body -100- and limited by the ends of the elongate holes -141- and -142-. On moving the fastener element -130- from one end to the other of each respective elongate hole -141- and -142-, the fastener element -130- is moved causing the ends -111- and -121- of said fastener element -130- to project from the respective holes -110- and -120-. The ends -111- and -121- of said fastener element -130-, by projecting from the respective holes -110- and -120- of the base body -100-, enter into respective holes -410- and -420- of the external element -400- for receiving said ends -111- and -121-, producing the connection between the base body -100- and the external element -400-. To ensure efficient retention of said connection between the pickup -300- support -1- and the musical instrument body, which will comprise the external element -400-, as explained above the two helical springs -131- and -132- apply constant pressure at all times to said fastener element -130- against the lower plate -140- of the base body -100-, and also to the ends -111- and -121- at the respective points of connection in the holes -410- and -420-.

Optionally, as can be seen in FIG. 11, the alignment of the respective holes (-110-, -120-) and (-410-, -420-) of the external element -400- and of the base body -100- may be stepped. In this case, the partially sloping termination of the ends -111- and -121- of the fastener element -130- will make it easier to move said fastener element -130- when being connected to the stringed musical instrument. Thus, on moving the fastener element -130- causing the ends -111- and -121- of said fastener element -130- to project from the respective holes -110- and -120-, said ends -111- and -121- will rise up the step formed between the respective holes (-110-, -120-) and (-410-, -420-) of the external element -400- and of the base body -100- so as to be able to enter respective holes -410- and -420- of the external element -400- for receiving said ends -111- and -121-. On rising vertically up said step, the fastener element -130- will also be raised to the position defined by the plane which contains the respective lower portions of the holes -410- and -420-. In addition, when the fastener element -130- rises vertically inside the base body -100-, the respective helical springs -131- and -132- contract slightly, ensuring in turn reliable retention of the fastener element -130- at the ends thereof -111- and -120- connected in the respective holes -410- and -420-.

FIGS. 14 to 18 are respective views of a second embodiment of a pickup -300- support -1'-. Said second embodiment comprises elements that are practically the same as those of the first embodiment, with the exception of what will be described below, and therefore similar elements with respect to the first embodiment may have the same reference numeral and will not be described with respect to said second embodiment.

In said second embodiment, the support -1'- also comprises a base body -100'- having a rectangular prismatic shape closed by a lower plate -140-. However, in this case, the base body -100'- respectively comprises, on the four vertical faces thereof, four respective holes -110-, -150-, -120- and -160- through which, as will be seen below, respective ends -111'-, -151-, -121- and -161- of a fastener element -130'-, illustrated in FIG. 16, may project. In this case, the fastener element -130'- may optionally comprise at least an elongate hole -135- which is different from the elongate holes -171- and -172- for manipulating the fastener element -130'-, said elongate hole -135- being configured to house internal elements of said pickup -300- support -1'-, such as attachment screws or additional springs, among others, and thus to allow unimpeded movement of the fastener element -130'-. Said configuration of four ends of the fastener element -130'- produces a connection that is more reliable and secure against vibrations that may arise during the use of the stringed musical instrument.

The connection and disconnection operation between the base body -100'- of the pickup -300- support -1'- and the external element -400- is the same as for the first embodiment and therefore, in this case, the user shall previously insert the respective fingers of his or her hand through the holes -171- and -172- of the fastener element -130'- through the respective elongate holes -141- and -142- of the lower plate -140- of the base body 100'- and move said fastener element -130'- along the trajectory defined internally in the base body -100'- and limited by the ends of the elongate holes -141- and -142-. In this case, on moving the fastener element -130'- from one end to the other of each respective elongate hole -141- and -142-, the fastener element -130'- is moved causing the ends -111'-, -151-, -121- and -161- of said fastener element -130'- to project from the respective holes -110-, -150-, -120- and -160-, and enter respectively into respective holes in the external element -400- for receiving said ends -111'-, -151-, -121- and -161-, producing the connection between the base body -100'- and the external element -400-. In this case, too, in order to ensure efficient retention of said connection between the pickup -300- support -1'- and the musical instrument body, which will comprise the external element -400-, the two helical springs -131- and -132- apply constant pressure at all times to said fastener element -130'- against the lower plate -140- of the base body -100'-, and also to the ends -111'-, -151-, -121- and -161- at the respective points of connection in the respective holes for receiving said ends -111'-, -151-, -121- and -161-.

Although the invention has been set out and described with reference to embodiments thereof, it should be understood that these do not limit the invention, and that it is possible to alter many structural or other details that may prove obvious to persons skilled in the art after interpreting the subject matter disclosed in the present description, claims and drawings. Therefore, the scope of the present invention includes any variant or equivalent that could be considered covered by the broadest scope of the following claims.

What is claimed is:

1. An interchangeable pickup support for a stringed musical instrument comprising:

a base body configured to support a pickup for a stringed musical instrument, said base body comprising at least two openings on an outer surface thereof, a fastener having an elongated body and comprising at least two projection sections and two through holes to maneuver the fastener, and a source of pressure configured to apply pressure to the fastener, wherein the base body comprises a space in an interior thereof to accommodate the fastener, and the fastener is configured to be movable such that the at least two projection sections project in part through the respective openings of the base body to engage with a body of the stringed musical instrument directly or indirectly and that the at least two projection sections retract to disengage with the body of the stringed musical instrument.

2. The interchangeable pickup support according to claim 1, wherein the at least two projection sections are symmetrical.

3. The interchangeable pickup support according to claim 1, wherein the base body comprises four openings and the fastener comprises four symmetrical projection sections configured to project in part through the respective four openings arranged on the outer surface of said base body.

4. The interchangeable pickup support according to claim 1, wherein the fastener is movable in a radial direction relative to a midpoint thereof.

5. The interchangeable pickup support according to claim 1, wherein the two through holes are arranged on either side of a midpoint of the fastener, allowing the fastener to be manoeuvred by the action of two fingers of the user.

6. The interchangeable pickup support according to claim 1, wherein the source of pressure comprises two helical springs which are arranged vertically on the fastener and apply pressure to said fastener against the base body.

7. The interchangeable pickup support according to claim 1, wherein the fastener is a planar and the at least two projection sections have a partially sloping termination.

8. A stringed musical instrument, comprising an interchangeable pickup support according to claim 1.

9. A stringed musical instrument according to claim 8, wherein the instrument is an electric guitar.

* * * * *